US011375829B2

(12) United States Patent
Jamil

(10) Patent No.: US 11,375,829 B2
(45) Date of Patent: Jul. 5, 2022

(54) SUPPORT PILLOW ASSEMBLY

(71) Applicant: Andrew Jamil, West Bloomfield, MI (US)

(72) Inventor: Andrew Jamil, West Bloomfield, MI (US)

( * ) Notice: Subject to any disclaimer, the term of this patent is extended or adjusted under 35 U.S.C. 154(b) by 324 days.

(21) Appl. No.: 16/246,967

(22) Filed: Jan. 14, 2019

(65) Prior Publication Data

US 2020/0221887 A1 Jul. 16, 2020

(51) Int. Cl.

| | |
|---|---|
| ***A47G 9/10*** | (2006.01) |
| ***H04R 1/10*** | (2006.01) |
| *A47C 7/38* | (2006.01) |

(52) U.S. Cl.

CPC ..... *A47G 9/1045* (2013.01); *A47G 9/1009* (2013.01); *A47G 9/1081* (2013.01); *H04R 1/1008* (2013.01); *A47C 7/383* (2013.01); *A47G 2009/1018* (2013.01)

(58) Field of Classification Search

CPC ..... A47G 9/10; A47G 9/1072; A47G 9/109; A47G 9/1045; A47G 9/1009; A47G 9/1081; A47G 2009/1018; H04R 1/10; H04R 1/1008; H04R 5/023; H04R 5/0335; A47C 7/383; A42B 1/245; A42B 3/306; A61F 5/055; A61F 11/14; A61F 2011/145

See application file for complete search history.

(56) References Cited

U.S. PATENT DOCUMENTS 3,290,450 A * 12/1966 Majoros ..... A47G 9/1045 381/182
3,384,719 A * 5/1968 Lanzara ..... H04R 5/023 381/301
3,792,754 A * 2/1974 Hanson ..... H04R 5/0335 181/130
4,243,851 A * 1/1981 Forney ..... H04R 5/0335 381/378
4,440,443 A * 4/1984 Nordskog ..... B64D 11/0606 297/397
4,546,215 A * 10/1985 Ferraro ..... H04R 1/1058 2/209

(Continued)

FOREIGN PATENT DOCUMENTS

CN 201226585 Y 4/2009
CN 103458742 A 12/2013

(Continued)

*Primary Examiner* — Peter M. Cuomo
*Assistant Examiner* — Rahib T Zaman
(74) *Attorney, Agent, or Firm* — Fishman Stewart PLLC

(57) ABSTRACT

A support pillow assembly includes a body having a first portion and a second portion. The first portion may include a first recess and/or a first channel. The first channel may extend from a top of the first recess. The second portion may include a second recess and/or a second channel. The second channel may extend from a top of the second recess. The body may include a curved configuration. The body may include a semispherical configuration. The first recess and/or the second recess may be substantially circular. The first channel and/or the second channel may be substantially rectangular. The first recess and/or the second recess may be configured to at least partially receive a first ear cup and/or a second ear cup of the pair of over-ear headphones, respectively.

20 Claims, 13 Drawing Sheets

(56) References Cited

U.S. PATENT DOCUMENTS 4,654,898 A * 4/1987 Ishikawa ..... H04R 1/1008 2/209
4,669,129 A * 6/1987 Chance ..... H04R 1/1008 181/129
4,776,044 A * 10/1988 Makins ..... A42B 1/245 2/172
4,782,533 A * 11/1988 Haynie ..... A47G 9/1045 381/301
4,797,934 A * 1/1989 Hufnagel ..... B60N 2/868 381/388
4,864,619 A * 9/1989 Spates ..... H04R 1/10 381/309
4,991,222 A * 2/1991 Nixdorf ..... H04R 5/023 297/391
5,123,133 A * 6/1992 Albert ..... A47G 9/10 381/301
5,241,971 A * 9/1993 Lundin ..... A61F 11/14 128/864
5,257,420 A * 11/1993 Byrne, Jr. ..... A61F 11/06 2/209
5,303,426 A * 4/1994 Jones ..... A41D 20/00 2/181
5,313,678 A * 5/1994 Redewill ..... A47C 21/003 297/393
5,835,609 A * 11/1998 LeGette ..... A61F 11/14 381/385
5,881,390 A * 3/1999 Young ..... A41D 20/00 2/209.13
6,098,220 A * 8/2000 Momma ..... A47G 9/1009 5/636
6,289,538 B1 * 9/2001 Fidge ..... A47C 7/383 297/393
6,668,407 B1 * 12/2003 Reitzel ..... A47C 1/14 5/639
6,698,028 B2 * 3/2004 Daw ..... H04R 1/1008 2/209
7,212,645 B2 * 5/2007 Le Gette ..... H04R 1/06 381/301
7,571,503 B2 * 8/2009 Gabriel ..... A47C 7/383 5/636
7,668,330 B2 * 2/2010 Siskin ..... A61F 11/14
7,926,133 B2 * 4/2011 Xiao ..... A47G 9/1045 5/639
8,144,913 B1 * 3/2012 Myles, Jr. ..... H04R 5/023 381/374
8,213,670 B2 * 7/2012 Lai ..... H04R 5/0335 381/388
8,566,986 B1 * 10/2013 Chu ..... A47G 9/1054 5/636
9,155,409 B2 * 10/2015 Cohen ..... A47C 27/081
10,390,638 B2 * 8/2019 Kim ..... A47G 9/1045
2003/0060744 A1 * 3/2003 Caille ..... A61F 5/00 602/18
2007/0253591 A1 * 11/2007 Popilek ..... H04R 5/023 381/388
2008/0216244 A1 * 9/2008 Minton ..... A47G 9/10 5/640
2018/0078063 A1 * 3/2018 Wallace ..... A47G 9/1045

FOREIGN PATENT DOCUMENTS

GB 2506112 A 3/2014
KR 200448833 Y1 5/2010

* cited by examiner

SUPPORT PILLOW ASSEMBLY

TECHNICAL FIELD

The present disclosure generally relates to a support pillow assembly that may include adjustment portions that may be used in connection with over-ear headphones.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

Some support pillow assemblies may be relatively complex and/or may not provide sufficient functionality. Some support pillow assemblies may not be configured to be adjustable and/or may not be compatible with over-ear headphones.

There is a desire for solutions/options that minimize or eliminate one or more challenges or shortcomings of support pillow assemblies. The foregoing discussion is intended only to illustrate examples of the present field and should not be taken as a disavowal of scope.

SUMMARY

In embodiments, a support pillow assembly may include a body, and/or the body may include a first portion and/or a second portion. The first portion may include a first recess and/or a first channel. The first channel may extend from a top of the first recess. The second portion may include a second recess and/or a second channel. The second channel may extend from a top of the second recess. The body may include a curved configuration. The body may include a semispherical configuration. The first recess and/or the second recess may be substantially circular. The first channel and/or the second channel may be substantially rectangular. The first recess and/or the second recess may be configured to at least partially receive a first ear cup and/or a second ear cup of a pair of over-ear headphones, respectively.

With embodiments, the first channel and/or the second channel may be configured to at least partially receive a headband of the pair of over-ear headphones. The first recess may be disposed proximate a front end of the first side portion. The second recess may be disposed proximate a front end of the second side portion. The shell may be connected to an outer surface of the body. The body may not include audio components.

In embodiments, a support pillow assembly may include a shell and/or a body. The body may include a first portion and/or a second portion. The shell may be connected to the body. A rear end of the first portion and/or a rear end of the second portion may be adjustably connected. The shell may include a first portion and/or a second portion. The first portion of the shell may be connected to the first portion of the body. The second portion of the shell may be connected to the second portion of the body. The first portion of the shell may be configured to move with the first portion of the body, and/or the second portion of the shell may be configured to move with the second portion of the body. The shell may include an adjustment portion that may be configured to adjust the first portion of the shell with respect to the second portion of the shell.

With embodiments, the adjustment portion may include a first segment and/or a second segment. The first segment may be configured to selectively engage the second segment. The first segment may include a protrusion, and/or the second segment may include a first recess. The protrusion may be configured to selectively engage the first recess. The first segment may include a second recess. The support pillow assembly may include a first width when the protrusion is engaged with the first recess. The support pillow may include a second width with the protrusion is engaged with the second recess. The first portion of the shell may be configured to rotate into engagement with the second portion of the shell via the first segment and/or the second segment. The second segment may include a latch member that may have a protrusion. The first segment may include a plurality of apertures. The latch member may be configured to deflect to selectively engage and/or disengage the aperture.

In embodiments, the adjustment portion may include a fastener. The first segment may include a protrusion that may have a plurality of first recesses. The second segment may include a second recess and/or an aperture. The aperture may be configured to at least partially receive the fastener, and/or the fastener may be configured to selectively engage at least one of the first recesses via the aperture. The shell may be substantially rigid, and/or the body may be substantially resilient.

The foregoing and other aspects, features, details, utilities, and/or advantages of embodiments of the present disclosure will be apparent from reading the following description, and from reviewing the accompanying drawings.

DETAILED DESCRIPTION

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications, and equivalents.

Figure 1A:
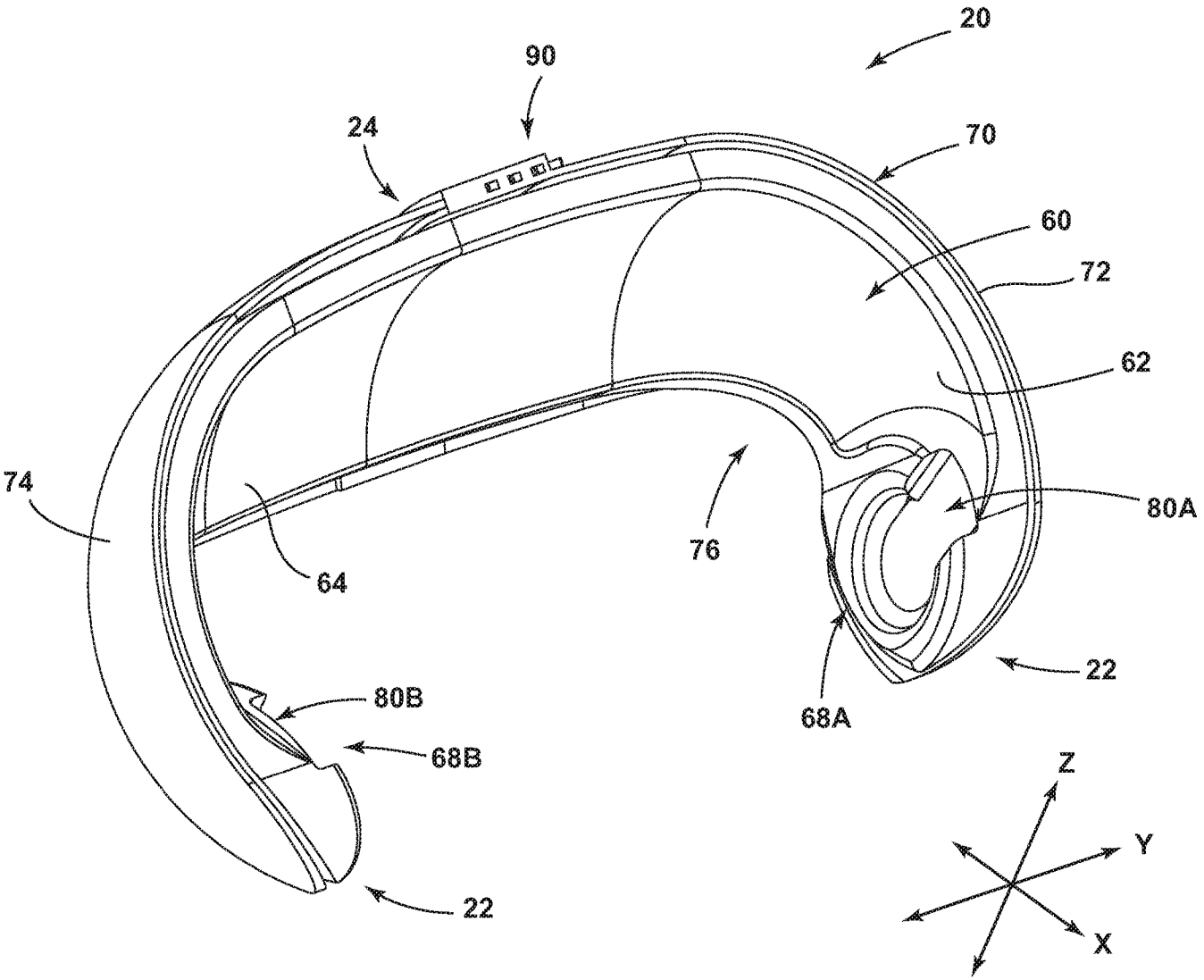
FIG. 1A is a perspective view generally illustrating an embodiment of a support pillow assembly according to teachings of the present disclosure.
Figure 1B:
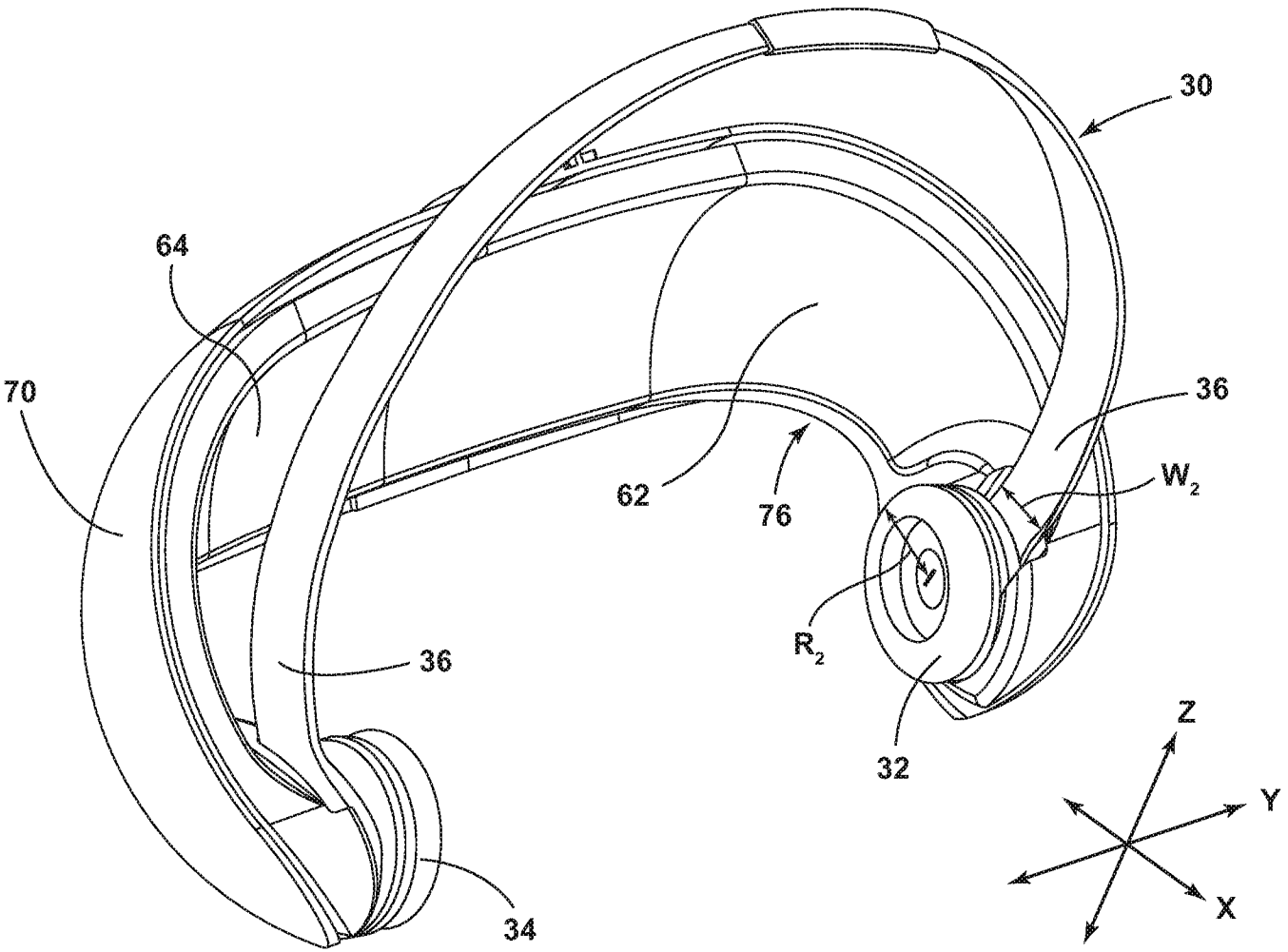
FIG. 1B is a perspective view generally illustrating embodiments of a support pillow assembly and headphones according to teachings of the present disclosure.

In embodiments, such as generally illustrated in FIGS. 1A and 1B, the support pillow assembly 20 may include a body 60, a shell 70, and/or an adjustment portion 90. The support pillow assembly 20 may be configured as a neck pillow and/or to at least partially receive a pair of headphones 30. For example and without limitation, the headphones 30 may be over-ear headphones (e.g., headphones 30 may contact the head of a user 40, may at least partially receive ears of a user 40, and/or may not be disposed inside an ear of the user 40). Over-ear headphones 30 may include a first earcup 32, a second earcup 34, and/or a headband 36 connecting the earcups 32, 34. The support pillow assembly 20 may be configured to at least partially receive and/or support the headphones 30.

In embodiments, a support pillow assembly 20 may support a pair of headphones 30 on the head of a user 40. Supporting a pair of headphones 30 may include limiting movement of the headphones 30 with respect to the head of a user 40. The support pillow assembly 20 may connect to (e.g., clamp onto) the head of a user 40 and secure the headphones 30 to the user 40. The support pillow assembly 20 may or may not support the headphones 30 by contacting a shoulder of the user 40. Additionally or alternatively, the support pillow assembly 20 may support the headphones 30 by conforming to the neck and/or rear of the head of a user 40. For example and without limitation, a width 20W of the support pillow assembly 20 may increase and/or decrease to accommodate the size of a head of the user 40.

In embodiments, the support pillow assembly 20 may limit or prevent exterior forces from being exerted on the headphones 30, and/or the support pillow assembly 20 may absorb the forces (e.g., instead of forces acting on the headphones 30, the forces may act on the support pillow assembly 20). Forces acting on the headphones 30 may include a user 40 resting their head (e.g., a side of the head and/or rear) against a surface. The forces may be absorbed by the support pillow assembly 20 and may not act on the headphones 30 (e.g., discomfort to the ears and/or head of the user 40 may be minimized and/or avoided when forces are applied to the support pillow assembly 20.

In embodiments, such as generally shown in FIGS. 1A, 1B, 2A, and 2B, the body 60 may include a first portion 62 and/or a second portion 64. The first portion 62 may be disposed opposite the second portion 64. The first portion 62 may be connected (e.g., movably connected) to the second portion 64. The first portion 62 and/or the second portion 64 may include one or more of a variety of shapes, sizes, materials, and/or configurations. For example and without limitation, the first portion 62 and/or the second portion 64 may be curved and/or semispherical-shaped. The first portion 62 and/or the second portion 64 may be curved (e.g., laterally) generally 90 degrees, or more, or less. The body 60 may include a resilient material (e.g., foam, padding, rubber, etc.). The resilient material may be any material that may conform and/or deflect to fit to the head of a user 40, and/or that may absorb external forces to the support pillow assembly 20 while maintaining alignment of the earcups 32, 34 with the ears of a user 40. The body 60 may or may not include electrical components (e.g., audio components) that may be connected to a pair of over-ear headphones 30. For example and without limitation, the support pillow assembly 20 may or may not facilitate improved audio from the headphones 30 via electronic audio components.

Figure 3A:
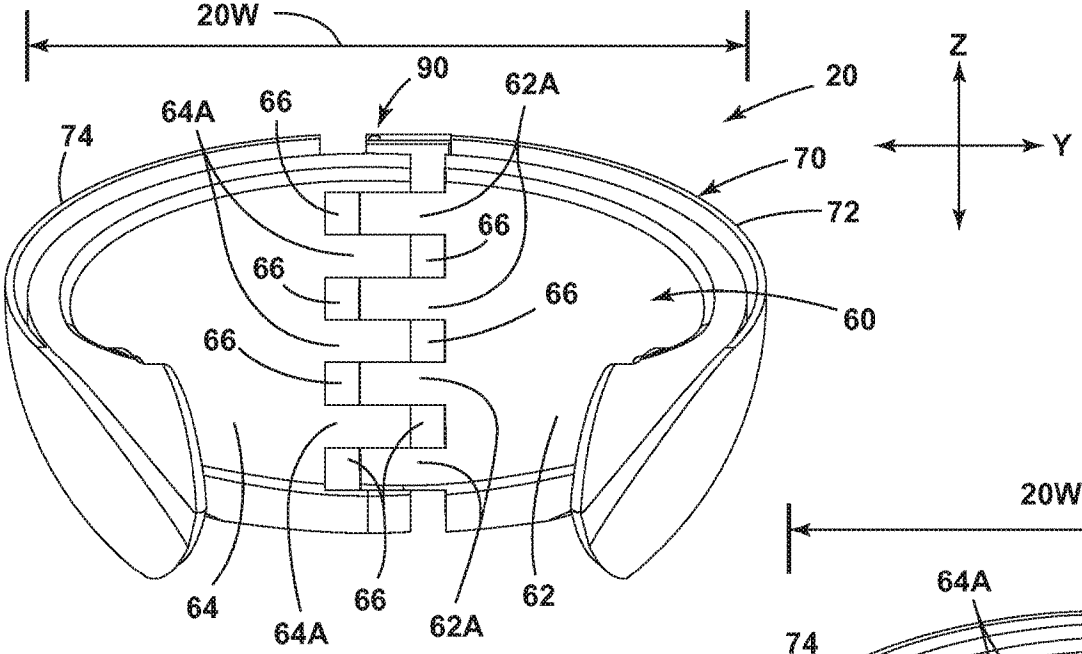
FIG. 3A is a side view generally illustrating an embodiment of a support pillow assembly according to teachings of the present disclosure.
Figure 3B:
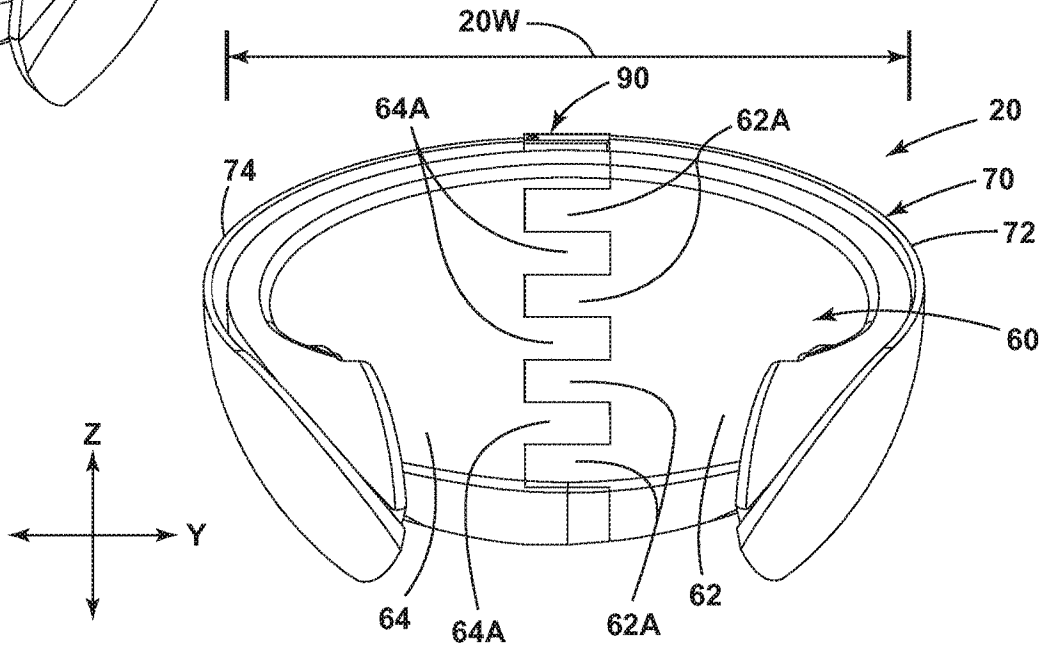
FIG. 3B is a side view generally illustrating an embodiment of a support pillow assembly according to teachings of the present disclosure.
Figure 4A:
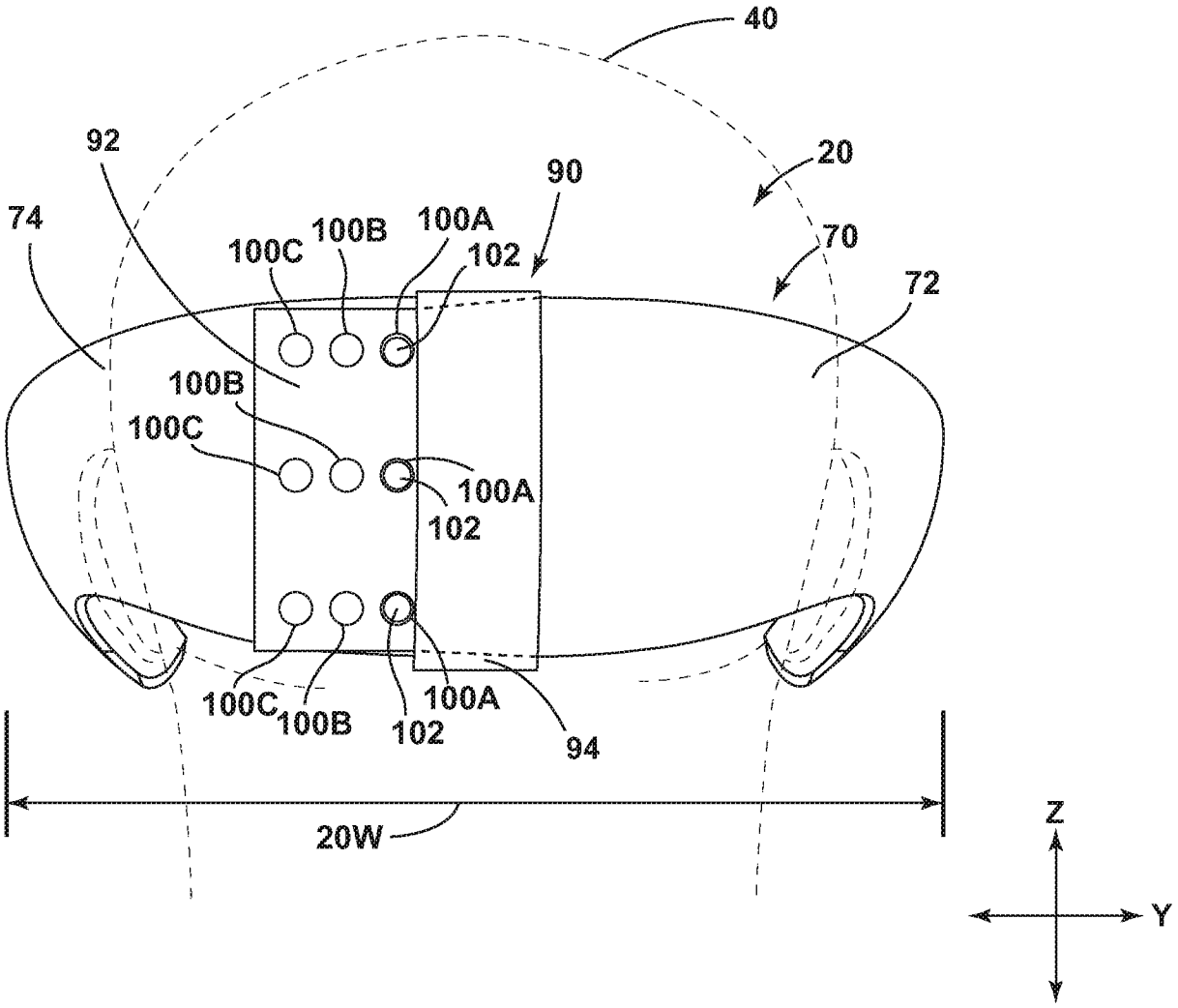
FIG. 4A is a side view generally illustrating an embodiment of a support pillow assembly according to teachings of the present disclosure.
Figure 4B:
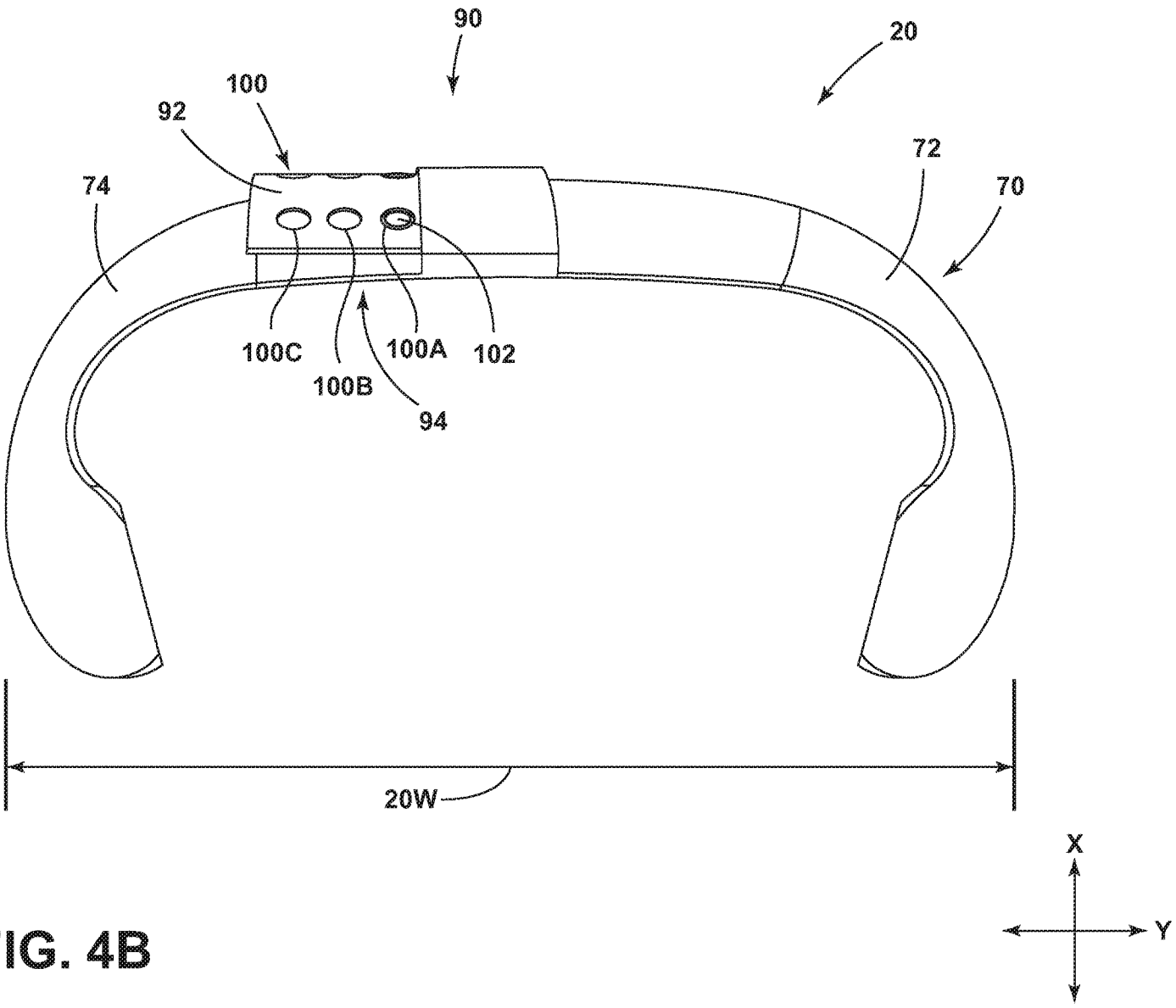
FIG. 4B is a bottom view generally illustrating an embodiment of a support pillow assembly according to teachings of the present disclosure.
Figure 4D:
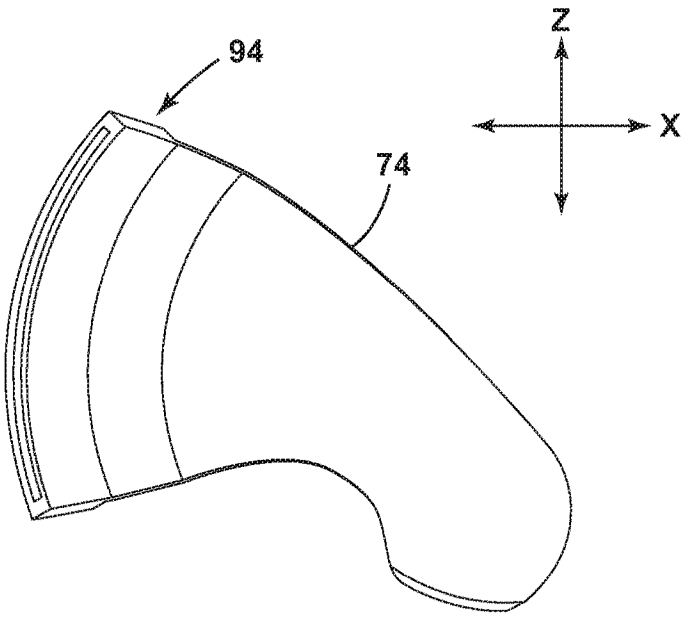
FIG. 4D is a perspective view generally illustrating portions of an embodiment of a support pillow assembly according to teachings of the present disclosure.
Figure 4C:
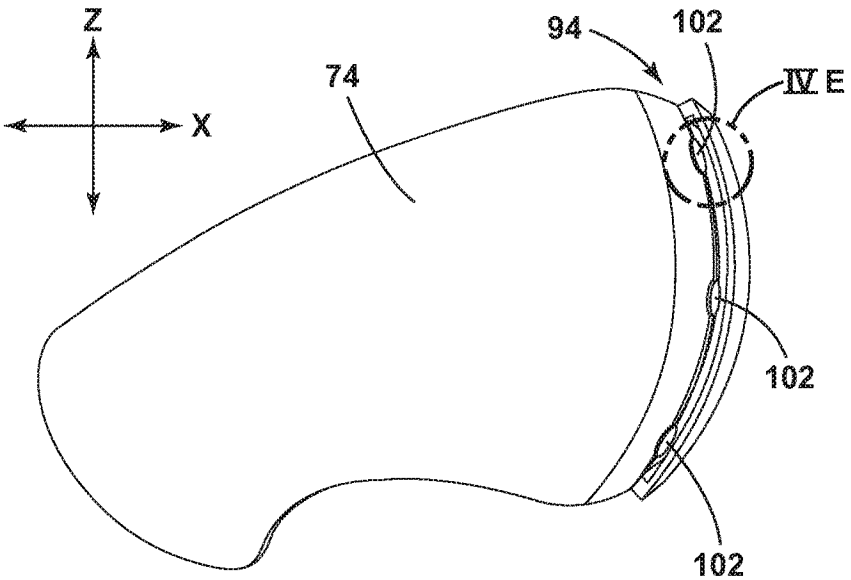
FIG. 4C is a perspective view generally illustrating portions of an embodiment of a support pillow assembly according to teachings of the present disclosure.
Figure 4E:
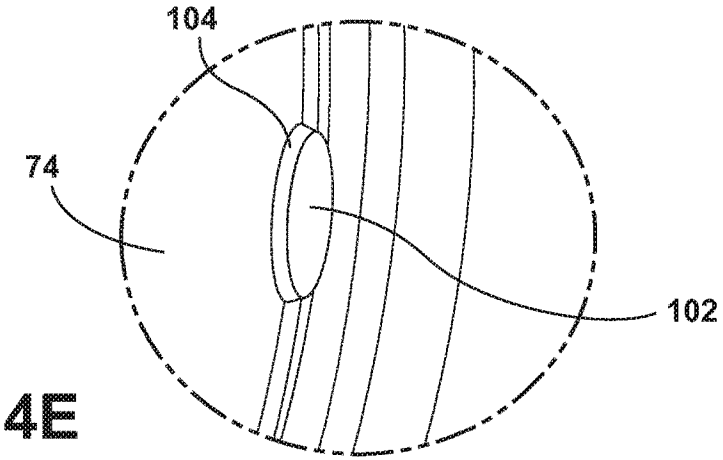
FIG. 4E is a perspective view generally illustrating portions of an embodiment of a support pillow assembly according to teachings of the present disclosure.

In embodiments, such as generally illustrated in FIGS. 3A and 3B, the first portion 62 and/or the second portion 64 of the body 60 may include a planar and/or toothed portions. The first portion 62 may include a first plurality of teeth 62A and/or the second portion 64 may include a second plurality of teeth 64A. The first plurality of teeth 62A may at least partially engage the second plurality of teeth 64A. The first portion 62 and the second portion 64 may be moved relative to each other. If the first portion 62 and the second portion 64 are moved away from each other, the width 20W of the support pillow assembly 20 may increase and/or gaps 66 (e.g., in the Y-direction) between the first plurality of teeth 62A and the second plurality of teeth 64A may increase. The width 20W of the support pillow assembly 20 may be the smallest with the first plurality of teeth 62A are completely engaged with the second plurality of teeth 64A.

With embodiments, such as generally illustrated in FIGS. 1A, 1B, 2A, and 2B, the support pillow assembly 20 may include a shell 70. The shell 70 may include a substantially rigid material (e.g., plastic, polymer, etc.). The shell 70 may not materially flex and/or deform when experiencing external forces. The shell 70 may include a first portion 72 and/or a second portion 74. The first portion 72 may be disposed opposite the second portion 74. The first portion 72 and/or the second portion 74 may include one or more of a variety of shapes, sizes, and/or configurations. For example and without limitation, the first portion 72 and/or the second portion 74 may be curved and/or semispherical-shaped. The first portion 72 and/or the second portion 74 of the shell 70 may have shapes that correspond to the first portion 62 and/or the second portion 64, respectively, of the body 60.

Figure 2A:
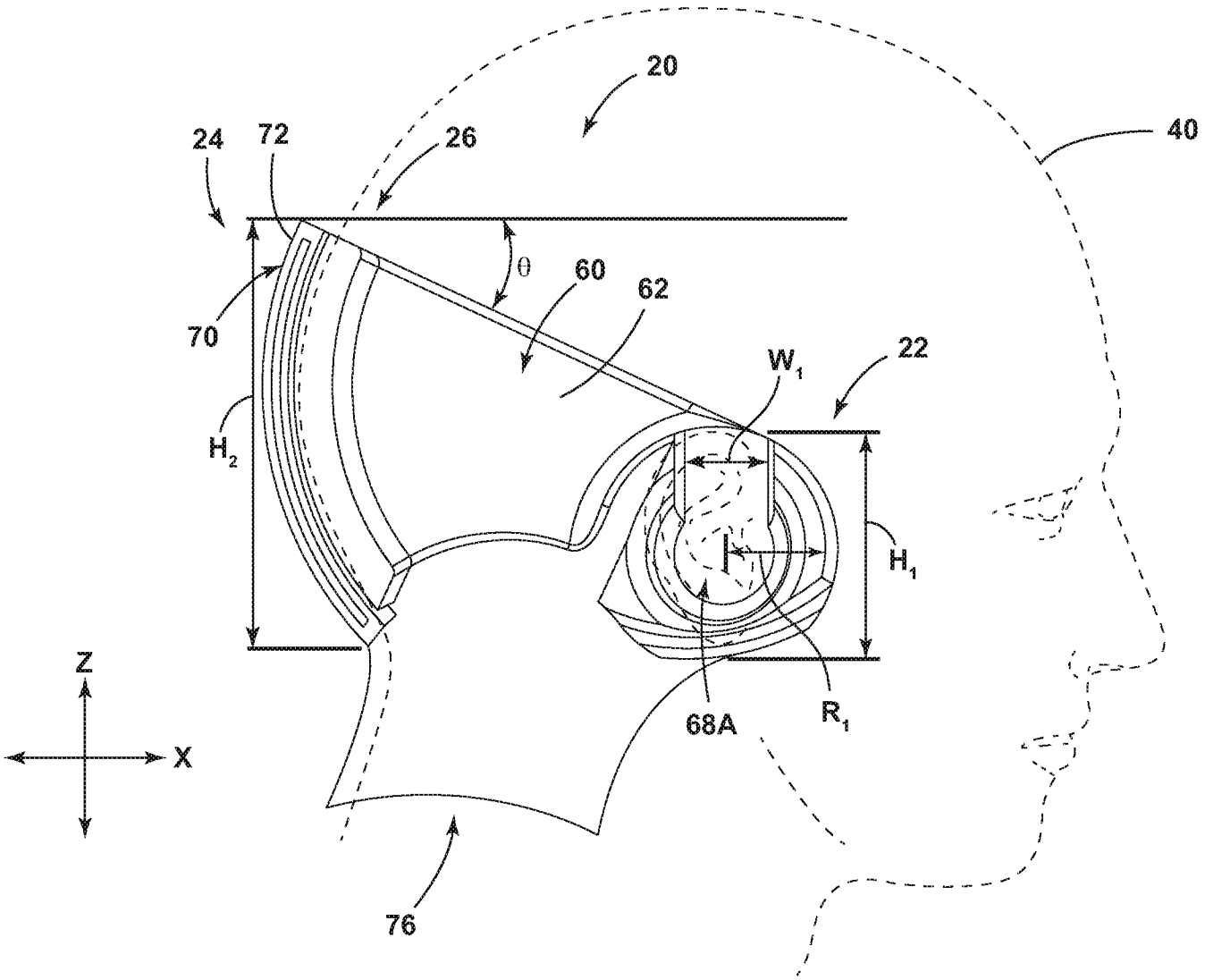
FIG. 2A is a cross-sectional view generally illustrating portions of an embodiment of a support pillow assembly according to teachings of the present disclosure.

In embodiments, such as generally illustrated in FIGS. 1A, 1B, 2A, and/or 2B, the shell 70 may be connected to the body 60 (e.g., an outer surface of the body 60 may be connected to an inner surface of the shell 70). The first portion 62 of the body 60 may be connected to the first portion 72 of the shell 70. The first portion 62 of the body 60 may be fixed (e.g., substantially immovably) to the first portion 72 of the shell 70. The second portion 64 of the body 60 may be connected to the second portion 74 of the shell 70. The second portion 64 of the body 60 may be fixed (e.g., substantially immovably) to the second portion 74 of the shell 70. The first portions 62, 72 may be movable with respect to the second portions 64, 74. For example and without limitation, the first portions 62, 72 may be adjustable with respect to the second portions 64, 74 such that the support pillow assembly 20 may adjust to the head of a user 40. The width 20W of the support pillow assembly 20 may be variable to accommodate different sizes of heads of users 40.

With embodiments, such as generally illustrated in FIGS. 1A and 2A, a first portion 62 and/or a second portion 64 of the body 60 may each include a groove 76. The groove 76 may include one or more of a variety of shapes, sizes, and/or configurations. For example and without limitation, the groove 76 may be substantially rounded and/or curved (e.g., may be substantially C-shaped and may open downward, such as generally illustrated in FIG. 2A). The groove 76 may be similar in shape to and/or configured to at least partially receive a top of a shoulder of a user 40. The support pillow assembly 20 may or may not contact a shoulder of a user 40 when in use. The groove 76 may be configured such that a shoulder of a user 40 may or may not contact the groove 76 and/or the support pillow assembly 20 if the support pillow assembly 20 is supporting the headphones 30 on the head of a user 40.

In embodiments, such as generally illustrated in FIGS. 1A and 2A, a front end 22 of the support pillow assembly 20 (e.g., the shell 70 and/or the body 60) may include a first height $H_1$. A rear end 24 of the support pillow assembly 20 (e.g., the shell 70 and/or the body 60) may include a second height $H_2$. The second height $H_2$ may be greater than the first height $H_1$. In embodiments, a top edge 26 of the support pillow assembly 20 (e.g., the shell 70 and/or the body 60) may be disposed at an angle θ (e.g., an acute angle). For example and without limitation, the top edge 26 may include an angle θ of about 30 degrees relative to a longitudinal/horizontal axis.

With embodiments, such as generally illustrated in FIGS. 1A, 1B, 2A, and 2B, the first portion 62 of the body 60 may include a first recess 68A, and/or the second portion 64 of the body 60 may include a second recess 68B. The recesses 68A, 68B may include one or more of a variety of shapes, sizes, and/or configurations. For example and without limitation, the recesses 68A, 68B may be rounded and/or substantially circular. The recesses 68A, 68B may generally be the same shape as the earcups 32, 34 of a pair of headphones 30. The recesses 68A, 68B may be configured to at least partially receive the first earcup 32 and/or the second earcup 34. The recesses 68A, 68B may include a depth $D_1$. The depth $D_1$ may be less than or equal to a depth $D_2$ of an earcup 32, 34. The recesses 68A, 68B may include a radius $R_1$. The radius $R_1$ may be greater than or equal to an outer radius $R_2$ of an earcup 32, 34. For example and without limitation, the radius $R_1$ may be about 0.5 inches to about 1.5 inches. The recesses 68A, 68B may be disposed at or about the front end 22 of the support pillow assembly 20 (e.g., such that when the support pillow assembly 20 is placed on the head of a user 40, the recesses 68A, 68B may be aligned with the ears of a user 40).

Figure 2B:
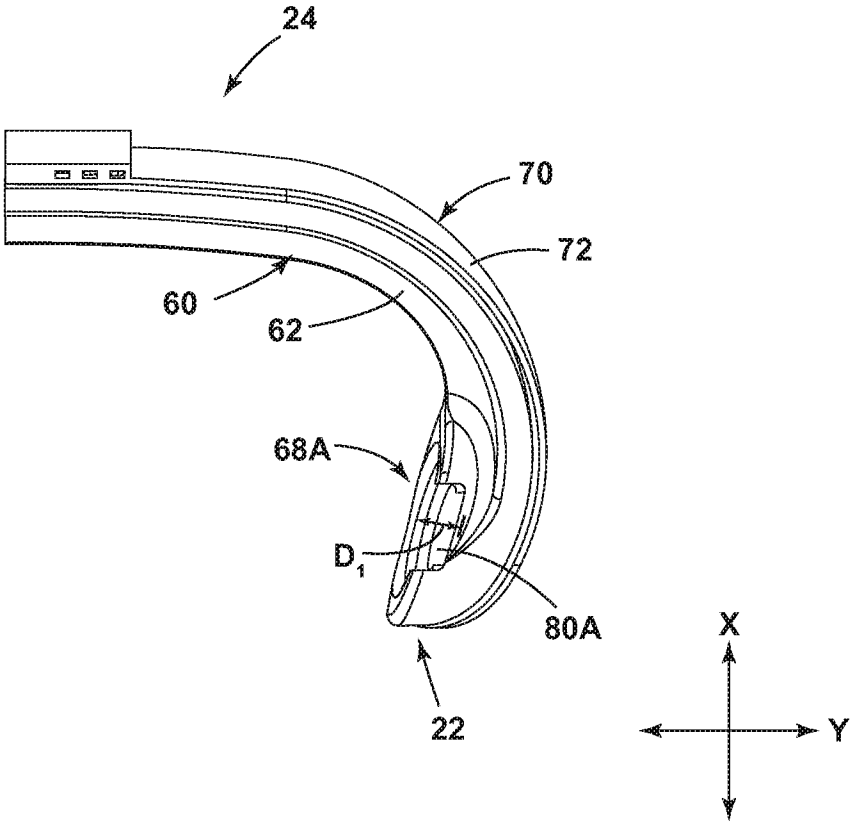
FIG. 2B is a top view generally illustrating portions of an embodiment of a support pillow assembly according to teachings of the present disclosure.

In embodiments, such as generally illustrated in FIGS. 2A and 2B, the body 60 may include one or more channels 80A, 80B. The first portion 62 may include a first channel 80A, and/or the second portion 64 may include a second channel 80B. The channels 80A, 80B may extend (e.g., vertically) from the recesses 68A, 68B, and/or the channels 80A, 80B may extend generally perpendicular to the body 60. A width $W_1$ of the channels 80A, 80B may be less than a diameter (e.g., two times radius $R_1$) of the recesses 68A, 68B. The channels 80A, 80B may include one or more of a variety of shapes, sizes, and/or configurations. For example and without limitation, the channels 80A, 80B may be substantially rectangular. The channels 80A, 80B may be configured to at least partially receive a headband 36 of the headphones 30 (e.g., the headband 36 may connect the first earcup 32 to the second earcup 34). The width $W_1$ of the channels 80A, 80B may be greater than or equal to an outer width $W_2$ of a headband 36. For example and without limitation, the width $W_1$ may be about 0.5 to 2 inches.

With embodiments, such as generally illustrated in FIGS. 3A-7B, the support pillow assembly 20 may include an adjustment portion 90. The adjustment portion 90 may connect the first portions 62, 72 of the body 60 and/or the shell 70 to the second portions 64, 74 of the body 60 and/or the shell 70. The adjustment portion 90 may secure the first portions 62, 72 to the second portions 64, 74 at various widths (e.g., the support pillow assembly 20 may be configured to be arranged in a variety of widths 20W via the adjustment portion 90). The adjustment portion 90 may be configured to secure the support pillow assembly 20 in a variety of different widths 20W in a transverse direction (e.g., the Y-direction), such as to compensate for heads of users 40 that may have different widths (e.g., between the ears).

In embodiments, such as generally illustrated in FIGS. 4A-7B. the adjustment portion 90 may include a first segment 92 and/or a second segment 94. The first segment 92 may be disposed at an inner end 72A of the first portion 72 of the shell 70 (see, e.g., FIG. 7A). The second segment 94 may be disposed at an inner end 74A of the second portion 74 of the shell 70. The first segment 92 may be configured to selectively engage the second segment 94, and/or the first segment 92 may be removable from the second segment 94.

With embodiments, such as generally illustrated in FIGS. 4A, 4B, 4C, 4D, and 4E, the second segment 94 may be configured to at least partially receive the first segment 92, such as from the Y-direction. When adjusting the width 20W of the support pillow assembly 20, the first segment 92 may be configured to receive different portions of the second segment 94 (e.g., which may correspond to different sizes for a user 40 to use the support pillow assembly 20).

In embodiments, the first segment 92 may include one or more recesses/apertures 100. The second segment 94 may include one or more protrusions 102 that may extend substantially perpendicularly from the surface of the second segment 94, such as in the X-direction. The protrusions 102 may at least partially engage the apertures 100. The protrusions 102 and the apertures 100 may be substantially the same shape. For example and without limitation, the protrusions 102 and/or the apertures 100 may be substantially circular, rounded, and/or oval shaped. A periphery of the protrusions 102 may include a ramped and/or sloped edge 104, which may facilitate engagement between the protrusions 102 and the apertures 100. If the first portion 72 of the shell 70 moves (e.g., transversely) toward and/or away from the second portion 74 of the shell 70, the ramped edge 104 of a protrusion 102 may facilitate engagement of the protrusion 102 with a respective aperture 100. The apertures 100 may be disposed in a first row 100A, a second row 100B, and/or a third row 100C. The first row 100A, the second row 100B, and/or the third row 100C may include one or a plurality of apertures 100 (e.g., one, two, three or more apertures). The second segment 94 may include a single row of protrusions 102 and/or may include a protrusion 102 for each aperture 100 in a row of apertures. For example and without limitation, if rows 100A, 100B, 100C each include two apertures 100, the second segment 94 may include two protrusions 102.

In embodiments, the first row 100A, the second row 100B, and/or the third row 100C may correspond to different overall widths 20W of the support pillow assembly 20. For example and without limitation, the first row 100A of apertures 100 may be engaged with the protrusions 102 and may correspond to a smaller width 20W of the support pillow assembly 20 than if the second row 100B of apertures 100 and/or the third row 100C of apertures 100 are engaged with the protrusions 102. The distance between the first row 100A of apertures 100, the second row 100B of apertures 100, and/or the third row 100C of apertures 100 may correspond to a distance that the width 20W of the support pillow assembly 20 may change.

Figure 5A:
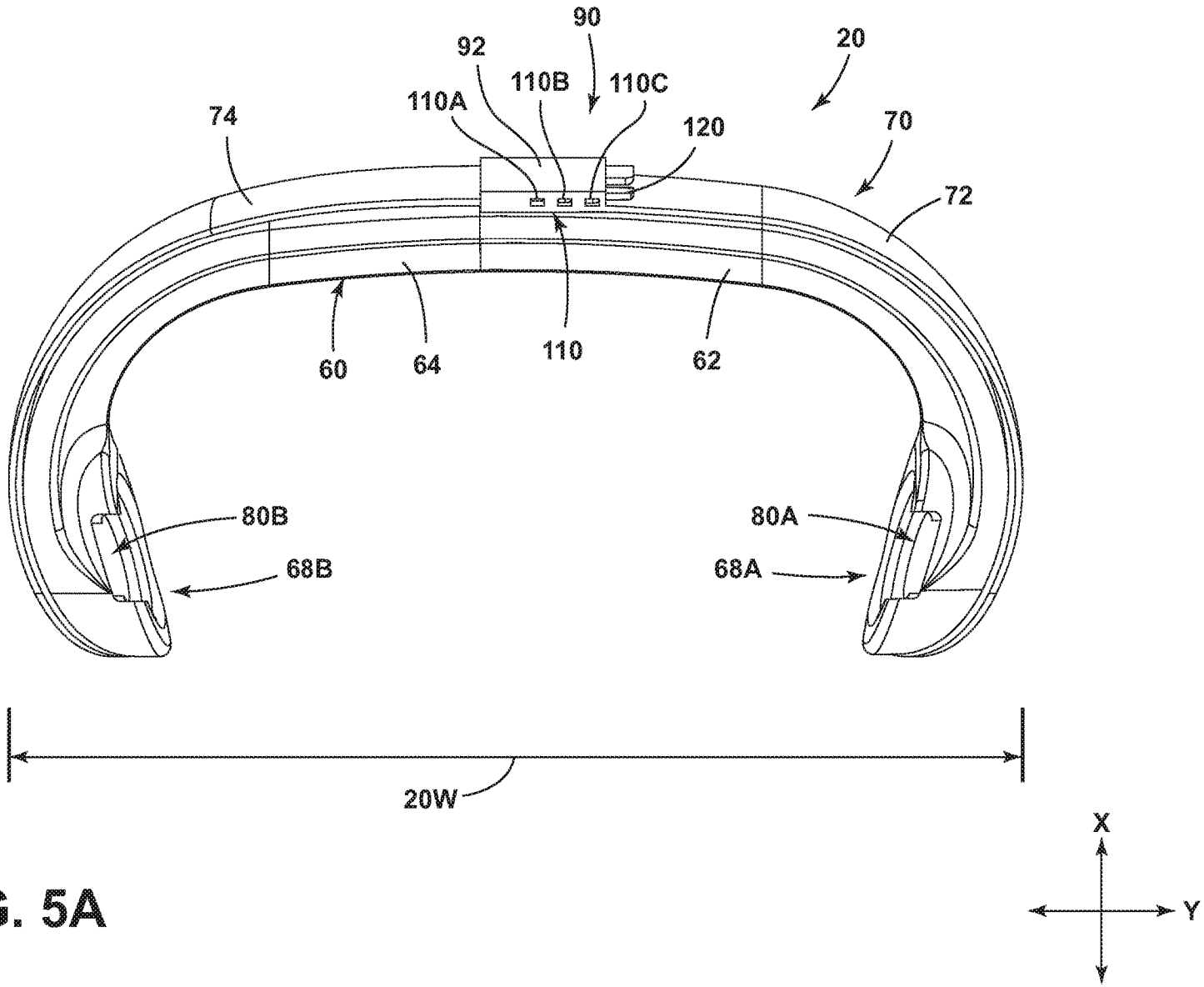
FIG. 5A is a top view generally illustrating an embodiment of a support pillow assembly according to teachings of the present disclosure.
Figure 5B:
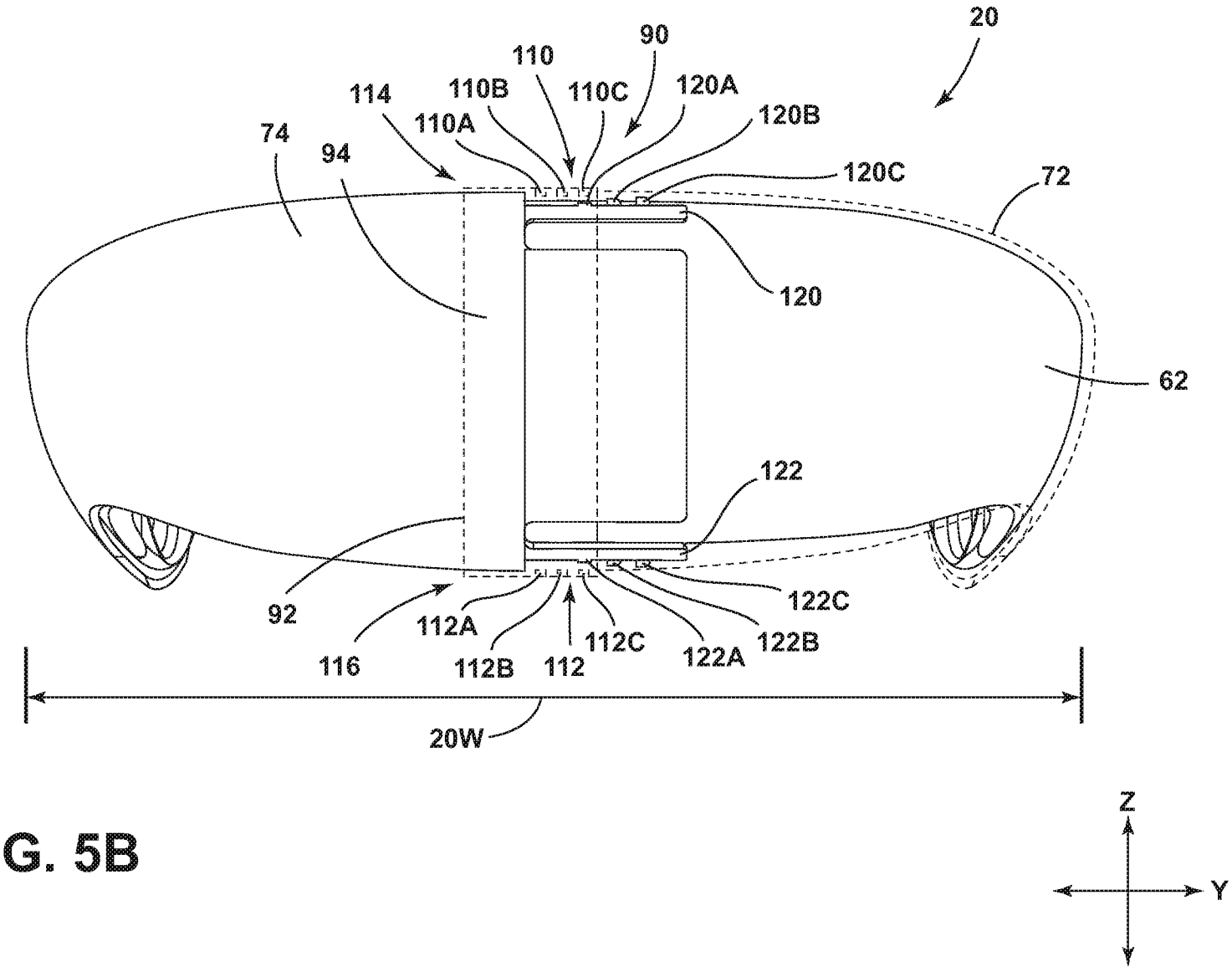
FIG. 5B is a side view generally illustrating an embodiment of a support pillow assembly according to teachings of the present disclosure.

With embodiments, such as generally illustrated in FIGS. 5A and 5B, the first segment 92 may include a first plurality of apertures 110 and/or a second plurality of recesses/apertures 112. The first plurality of apertures 110 may be disposed on a first side 114 of the first segment 92, and/or the second plurality of apertures 112 may be disposed on a second side 116 of the first segment 92. The first plurality of apertures 110 and/or the second plurality of apertures 112 may include a first aperture 110A, 112A, a second aperture 110B, 112B, and/or a third aperture 110C, 112C. The first apertures 110A, 112A may be disposed closer to the second segment 94 than the second apertures 110B, 112B and/or the third apertures 110C, 112C (e.g., the first apertures 110A, 112A may be disposed at or about an end of the first segment 92). The second apertures 110B, 112B may be disposed closer to the second segment 94 than the third apertures 110C, 112C. The first apertures 110A, 112A, the second apertures 110B, 112B, and/or the third apertures 110C, 112C may be substantially aligned.

In embodiments, the second segment 94 may include a first member 120 and/or a second member 122. The first member 120 and/or the second member 122 may be configured to engage the first plurality of apertures 110 and/or the second plurality of apertures 112, respectively. The first member 120 and/or the second member 122 may extend from the second segment 94 of the adjustment portion 90, such as generally in the Y-direction. The first member 120 and/or the second member 122 may be generally rectangular shaped and/or elongated. The first member 120 and/or the second member 122 may each include a first protrusion 120A, 122A, a second protrusion 120B, 122B, and/or a third protrusion 120C, 122C. The protrusions 120A, 122A, 120B, 122B, 120C, 122C may be generally aligned with each other. The first protrusions 120A, 122A may be disposed closer to the first portion 72 of the shell 70 than the second protrusions 120B, 122B and/or the third protrusions 120C, 122C. The second protrusions 120B, 122B may be disposed closer to the first portion 72 of the shell 70 than the third protrusions 120C, 122C. The protrusions 120A, 122A, 120B, 122B, 120C, 122C may extend generally perpendicularly from the first member 120 and/or the second member 122. The first protrusions 120A, 122A may be shorter than the second protrusions 120B, 122B and/or the third protrusions 120C, 122C. The second protrusion 120B, 122B may shorter than the third protrusions 120C, 122C.

With embodiments, the protrusions 120A, 120B, 120C of the first member 120 may be configured to engage the first plurality of apertures 110, and/or the protrusions 122A, 122B, 122C of the second member 122 may be configured to engage the second plurality of apertures 112. The protrusions 120A, 122A, 120B, 122B, 120C, 122C may be configured to be at least partially disposed in the first apertures 110A, 112A, the second apertures 110B, 112B, and/or the third apertures 110C, 112C. The overall width 20W of the support pillow assembly 20 may be the greatest when the third protrusions 120C, 122C are engaged with the first apertures 110A, 112A. The overall width 20W of the support pillow assembly 20 may be the smallest when the first protrusions 120A, 122A are engaged with the third apertures 110C, 112C. When adjusting the adjustment portion 90, the first member 120 and/or the second member 122 may move (e.g., deflect, flex, etc.) in a direction away (e.g., the Z-direction) from the protrusions 120A, 122A, 120B, 122B, 120C, 122C such that the protrusions 120A, 122A, 120B, 122B, 120C, 122C may disengage the apertures 110, 112. For example the first member 120 and/or the second member 122 may flex in a direction towards each other (e.g., the Z-direction) via the user 40 pinching the ends of the first member 120 and/or the second member 122. The first member 120 and/or the second member 122 may remain flexed/displaced while the first portion 72 of the shell 70 is moved towards and/or away from the second portion 74 of the shell 70. When the support pillow assembly 20 is at a desirable width 20W, the first member 120 and/or the second member 122 may be released such that at least one protrusion 120A, 122A, 120B, 122B, 120C, 122C may engage at least one aperture of the first plurality of apertures 110 and/or the second plurality of apertures 112. The members 120, 122 may be biased toward engagement with the apertures 110, 112.

Figure 6A:
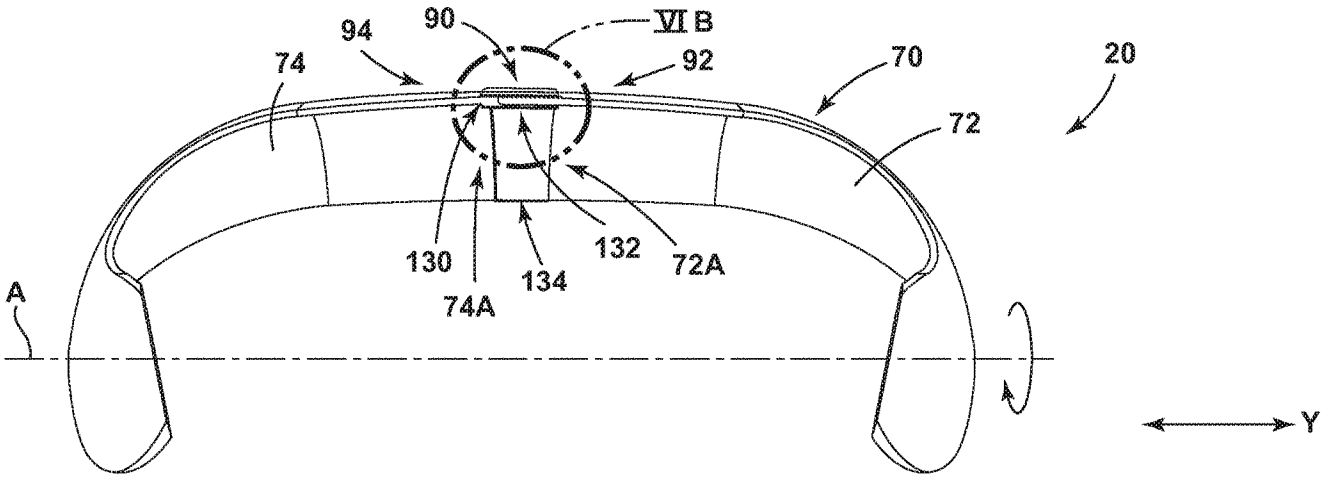
FIG. 6A is a perspective view generally illustrating portions of an embodiment of a support pillow assembly according to teachings of the present disclosure.
Figure 6B:
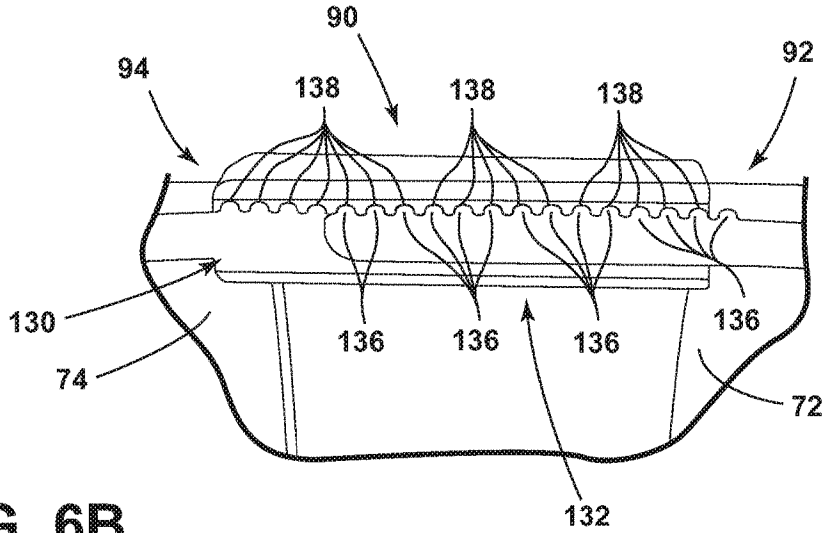
FIG. 6B is a perspective view generally illustrating portions of an embodiment of a support pillow assembly according to teachings of the present disclosure.
Figure 6C:
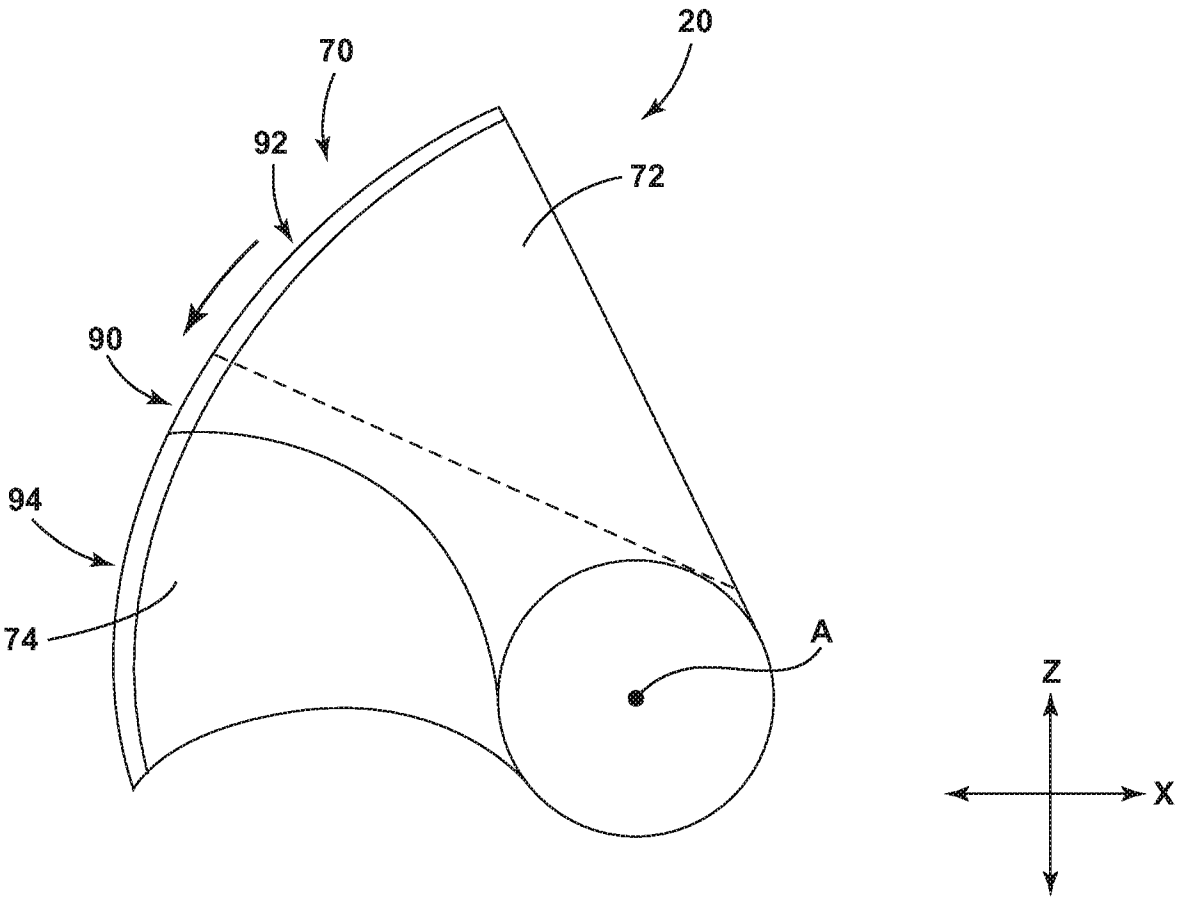
FIG. 6C is a side view generally illustrating portions of an embodiment of a support pillow assembly according to teachings of the present disclosure.

In embodiments, such as generally illustrated in FIGS. 6A, 6B, and 6C, the second segment 94 of the adjustment portion 90 may include a recess 130. The recess 130 may extend along the length of the first segment 92 (e.g., substantially in the Z-direction). The recess 130 may be substantially open at a first end 132 and/or the recess 130 may be substantially closed at a second end 134. The first segment 92 may include one or more ribs 136 (e.g., that may generally form a ribbed surface). The ribs 136 may be substantially perpendicular to the first segment 92 of the adjustment portion 90. The ribs 136 may be disposed in an array along the Y-direction. The recess 130 may include one or more channels 138 that may correspond to the one or more ribs 136 (see, e.g., FIG. 6B). At least one of the ribs 136 of the second segment 94 may engage at least one channel 138 of the first segment 92.

With embodiments, the second segment 94 may be inserted (e.g., rotated) into the first segment 92. The first segment 92 may be rotated about axis A (e.g., an axis that may be substantially horizontal) into engagement with the second segment 94 at the first end 132 of the recess 130. The first segment 92 may be rotated into engagement with the second segment 94 until the first segment 92 contacts the second end 134 of the recess 130. The connection between the first segment 92 and the second segment 94 may be completed when the first segment 92 may not be rotated further. The number of channels 138 and/or the number of ribs 136 may correspond to the number of different widths 20W of the support pillow assembly 20. The width 20W of the support pillow assembly 20 may be the smallest when all the ribs 136 are engaged with all the channels 138. The width 20W of the support pillow assembly 20 may be the greatest when only one rib 136 is engaged with only one channel 138.

Figure 7A:
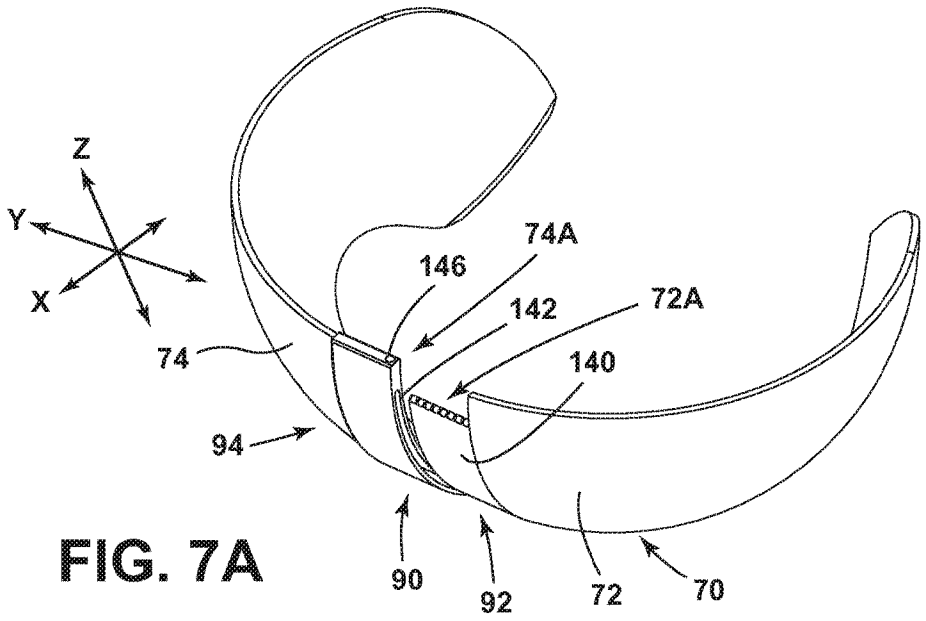
FIG. 7A is a perspective view generally illustrating portions of an embodiment of a support pillow assembly according to teachings of the present disclosure.
Figure 7B:
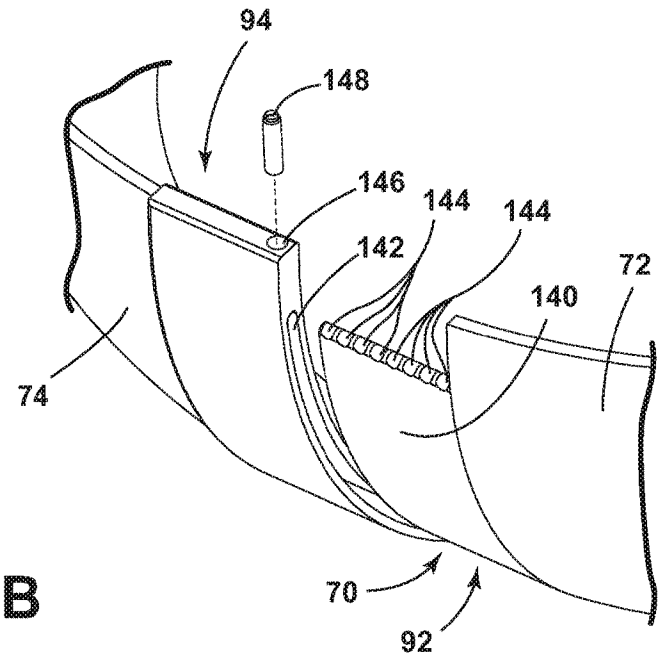
FIG. 7B is a perspective view generally illustrating portions of an embodiment of a support pillow assembly according to teachings of the present disclosure.

In embodiments, such as generally illustrated in FIGS. 7A and 7B, the first segment 92 may be configured to engage the second segment 94. The first segment 92 may be at least partially received by the second segment 94. The first segment 92 may be inserted into the second segment 94 substantially in the Y-direction. The first segment 92 may include a protrusion 140, and/or the second segment 94 may include a recess 142. The protrusion 140 may be configured to be at least partially disposed in the recess 142. The recess 142 and/or the protrusion 140 may extend substantially in the Y-direction. The recess 142 and/or the protrusion 140 may generally include a similar shape.

With embodiments, the protrusion 140 may include a plurality of engagement recesses 144. The engagement recesses 144 may extend substantially perpendicular to the protrusion 140. The plurality of engagement recesses 144 may be substantially aligned along a top surface of the protrusion 140. The second segment 94 may include an aperture 146 and/or a fastener 148. The aperture 146 may be configured to receive at least a portion of the fastener 148 (e.g., a screw, a bolt, etc.). When the first segment 92 is disposed in the second segment 94, the fastener 148 may extend through the aperture 146 and/or the fastener 148 may engage an engagement recess 144 of the second segment 94. Engagement between the fastener 148 and/or an engagement recess 144 may restrict and/or prevent movement in at least one direction (e.g., the Y-direction) of the first portion 62, 72 with respect to the second portion 64, 74. When the fastener 148 is not engaged with an engagement recess 144, the first portions 62, 72 may move (e.g., in the Y-direction) toward and/or away from the second portions 64, 74. Moving the first portion 62, 72 with respect to the second portion 64, 74 may allow a user 40 to adjust the width 20W of the support pillow assembly 20 and/or may allow the user 40 to separate the portions 72, 74 of the shell 70 and/or the portions 62, 64 of the body 60. Separating the portions 72, 74 of the shell 70 and/or the portions 62, 64 of the body 60 may facilitate storage of the support pillow assembly 20 (e.g., the first portions 62/72 may be stacked with the second portions 64, 74).

Some figures may show the shell 70 with the body 60 not shown or hidden for illustrative purposes, but embodiments of adjustment portions 90 may be configured for adjusting the position of the body portions 62, 64 along with the corresponding shell portions 72, 74 (e.g., simultaneously).

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. A support pillow assembly, comprising:

a body, the body including:

a first portion; and a second portion;

wherein the first portion includes a first recess and a first channel extending from a top of the first recess and formed in an external surface of the first portion; and the second portion includes a second recess and a second channel extending from a top of the second recess and formed in an external surface of the second portion;

the first recess is configured to at least partially receive an ear cup of a pair of over-ear headphones; and the first channel is configured to at least partially receive a headband of the pair of over-ear headphones.

2. The support pillow assembly of claim 1, wherein the first portion of the body includes a groove configured to at least partially receive a top portion of a shoulder of a user.

3. The support pillow assembly of claim 1, wherein the first portion and the second portion are adjustable in a transverse direction; and the first channel extends upward from the top of the first recess substantially perpendicular to the transverse direction.

4. The support pillow assembly of claim 1, wherein the first recess and the second recess are substantially circular, and the first channel and the second channel are substantially rectangular.

5. The support pillow assembly of claim 1, wherein the second recess is configured to at least partially receive a second ear cup of the pair of over-ear headphones.

6. A support pillow assembly, comprising:

a body, the body including:

a first portion; and a second portion;

wherein the first portion includes a first recess and a first channel extending from a top of the first recess;

the second portion includes a second recess and a second channel extending from a top of the second recess;

the first recess and the second recess are configured to at least partially receive a first ear cup and a second ear cup of a pair of over-ear headphones, respectively; and wherein the first channel and the second channel are configured to at least partially receive a headband of the pair of over-ear headphones.

7. The support pillow assembly of claim 1, wherein a top edge of the body is disposed at an acute angle such that a rear of the body has a greater height than a front of the body.

8. The support pillow assembly of claim 1, including a substantially rigid shell connected to an outer surface of the body;

wherein a rear end of the first portion and a rear end of the second portion are adjustably connected.

9. A support pillow assembly configured to support a pair of headphones on a head of a user, the support pillow assembly comprising:

a shell; and a body, the body including:

a first portion having a first recess and a first channel; and a second portion having a second recess and a second channel;

wherein the first recess and the second recess are configured to at least partially receive a first ear cup and a second ear cup of the pair of headphones, respectively;

the first channel and the second channel are configured to at least partially receive respective portions of a headband of the pair of headphones;

the shell is connected to the body; and a rear end of the first portion and a rear end of the second portion are adjustably connected.

10. The support pillow assembly of claim 9, wherein the shell includes a first portion and a second portion; the first portion of the shell is connected to the first portion of the body; and the second portion of the shell is connected to the second portion of the body.

11. The support pillow assembly of claim 10, wherein the first portion of the shell is configured to move with the first portion of the body; and the second portion of the shell is configured to move with the second portion of the body relative to the first portion of the body.

12. The support pillow assembly of claim 10, wherein the shell includes an adjustment portion configured to adjust the first portion of the shell with respect to the second portion of the shell.

13. The support pillow assembly of claim 12, wherein the adjustment portion includes a first segment and a second segment; and the first segment is configured to selectively engage the second segment.

14. The support pillow assembly of claim 13, wherein the first segment includes a protrusion; the second segment includes a first recess; and the protrusion is configured to selectively engage the first recess of the second segment.

15. The support pillow assembly of claim 14, wherein the second segment includes a second recess; the support pillow assembly includes a first width when the protrusion is engaged with the first recess of the second segment; and the support pillow assembly includes a second width when the protrusion is engaged with the second recess of the second segment.

16. The support pillow assembly of claim 13, wherein the first portion of the shell is configured to rotate about a substantially horizontal axis into engagement with the second portion of the shell via the first segment and the second segment.

17. The support pillow assembly of claim 13, wherein the second segment includes a latch member having a protrusion; the first segment includes a plurality of apertures; and the latch member is configured to deflect to selectively engage and disengage the aperture.

18. The support pillow assembly of claim 13, wherein the adjustment portion includes a fastener; the first segment includes a protrusion having a plurality of first recesses; the second segment includes a second recess and an aperture; the aperture is configured to at least partially receive the fastener; and the fastener is configured to selectively engage at least one of the first recesses of the protrusion via the aperture.

19. The support pillow assembly of claim 9, wherein the shell is substantially rigid; and the body is substantially resilient.

20. The support pillow assembly of claim 9, wherein the first portion does not include audio components.

* * * * *